US008926130B2

(12) United States Patent
Li et al.

(10) Patent No.: US 8,926,130 B2
(45) Date of Patent: Jan. 6, 2015

(54) ILLUMINATION DEVICE AND ASSEMBLING METHOD THEREOF

(75) Inventors: Chao-Wei Li, Hsinchu (TW); Hung-Lieh Hu, Hsinchu (TW); Chun-Chuan Lin, Hsinchu (TW); Chen-Peng Hsu, Kaohsiung (TW); Hsin-Hsiang Lo, Hsinchu County (TW); Ji-Feng Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 175 days.

(21) Appl. No.: 13/410,307

(22) Filed: Mar. 2, 2012

(65) Prior Publication Data

US 2013/0010472 A1 Jan. 10, 2013

Related U.S. Application Data

(60) Provisional application No. 61/504,328, filed on Jul. 5, 2011, provisional application No. 61/557,352, filed on Nov. 8, 2011.

(51) Int. Cl.

| | |
|---|---|
| ***F21S 4/00*** | (2006.01) |
| ***F21V 29/00*** | (2006.01) |
| ***F21K 99/00*** | (2010.01) |
| *F21Y 101/02* | (2006.01) |
| *F21Y 111/00* | (2006.01) |

(52) U.S. Cl.

CPC ..... *F21V 29/2231* (2013.01); *F21V 29/2237* (2013.01); *F21V 29/2293* (2013.01); *F21K 9/135* (2013.01); *F21V 29/262* (2013.01); *F21Y 2101/02* (2013.01); *F21Y 2111/005* (2013.01)

USPC ..... 362/249.02; 362/249.04; 362/294; 362/373; 362/650

(58) Field of Classification Search

USPC ..... 362/218, 249.02, 249.04, 649, 650, 362/294, 373

See application file for complete search history.

(56) References Cited

U.S. PATENT DOCUMENTS

| | | | | |
|---|---|---|---|---|
| 5,806,965 | A * | 9/1998 | Deese | 362/249.04 |
| 6,585,395 | B2 * | 7/2003 | Luk | 362/249.02 |

(Continued)

FOREIGN PATENT DOCUMENTS

| | | |
|---|---|---|
| CN | 201425182 | 3/2010 |
| CN | 101737657 | 6/2010 |

(Continued)

OTHER PUBLICATIONS

"Office Action of Japan Counterpart Application", issued on Jul. 23, 2013, p. 1-p. 4.

(Continued)

*Primary Examiner* — John A Ward

(74) *Attorney, Agent, or Firm* — Jianq Chyun IP Office

(57) ABSTRACT

An illumination device including a base, a heat dissipation member, at least one flexible printed circuit board (FPC), and a plurality of light-emitting elements is provided. The heat dissipation member disposed on the base has a central axis, a plurality of holding curvy surfaces and a plurality of heat dissipation channels extending along the central axis, wherein the holding curvy surfaces and the heat dissipation channels are staggered and arranged about the central axis, and each of the holding curvy surfaces radially extends along the central axis. The flexible printed circuit board is disposed on the holding curvy surfaces. The light-emitting elements are disposed on the flexible printed circuit board. An assembling method of the illumination device is also provided.

26 Claims, 17 Drawing Sheets

(56) References Cited

U.S. PATENT DOCUMENTS

| | | | | |
|---|---|---|---|---|
| 6,709,132 | B2 | 3/2004 | Ishibashi | |
| D508,575 | S | 8/2005 | Buschmann et al. | |
| 7,086,756 | B2 * | 8/2006 | Maxik | 362/249.04 |
| 7,568,817 | B2 | 8/2009 | Lee et al. | |
| 7,736,020 | B2 * | 6/2010 | Baroky et al. | 362/249.02 |
| 7,748,870 | B2 | 7/2010 | Chang et al. | |
| D626,667 | S | 11/2010 | Jonsson et al. | |
| D627,807 | S | 11/2010 | Tosti | |
| 7,862,204 | B2 * | 1/2011 | Lodhie | 362/249.02 |
| D645,993 | S | 9/2011 | Wang | |
| 8,013,501 | B2 * | 9/2011 | Carroll et al. | 313/46 |
| D651,327 | S | 12/2011 | Hsiao et al. | |
| 8,128,258 | B2 * | 3/2012 | Lodhie | 362/249.02 |
| 8,157,416 | B2 * | 4/2012 | Lodhie | 362/249.02 |
| D665,520 | S | 8/2012 | Breidenassel et al. | |
| D669,608 | S | 10/2012 | Sherman et al. | |
| D669,614 | S | 10/2012 | Sherman et al. | |
| 8,371,722 | B2 * | 2/2013 | Carroll | 362/311.02 |
| D677,807 | S | 3/2013 | Holland et al. | |
| 8,421,322 | B2 * | 4/2013 | Carroll et al. | 313/46 |
| 8,461,748 | B1 * | 6/2013 | Taj | 313/46 |
| 2005/0174769 | A1 | 8/2005 | Yong et al. | |
| 2005/0207152 | A1 | 9/2005 | Maxik | |
| 2007/0291482 | A1 * | 12/2007 | Baroky et al. | 362/227 |
| 2008/0316755 | A1 | 12/2008 | Zheng et al. | |
| 2009/0116233 | A1 | 5/2009 | Zheng et al. | |
| 2009/0251882 | A1 | 10/2009 | Ratcliffe | |
| 2009/0302730 | A1 | 12/2009 | Carroll et al. | |
| 2010/0314985 | A1 | 12/2010 | Premysler | |
| 2011/0103055 | A1 | 5/2011 | Carroll | |
| 2011/0156584 | A1 * | 6/2011 | Kim | 315/32 |

FOREIGN PATENT DOCUMENTS

| | | |
|---|---|---|
| CN | 201983030 | 9/2011 |
| JP | 2003059305 | 2/2003 |
| TW | M374539 | 2/2010 |
| TW | M387960 | 9/2010 |
| TW | M404343 | 5/2011 |
| TW | D150457 | 11/2012 |

OTHER PUBLICATIONS

"Office Action of Taiwan counterpart application" issued on Mar. 7, 2013, p. 1-p. 3.

"Notice of Allowance of U.S. counterpart application" issued on Apr. 22, 2013, p. 1-p. 7.

"Office Action of Japan Counterpart Application", issued on Dec. 17, 2013, p. 1-p. 4.

"Office Action of Taiwan Counterpart Application", issued on Apr. 22, 2014, p. 1-p. 8.

* cited by examiner

ILLUMINATION DEVICE AND ASSEMBLING METHOD THEREOF

CROSS-REFERENCE TO RELATED APPLICATION

This application claims the priority benefits of U.S. provisional application Ser. No. 61/504,328, filed on Jul. 5, 2011 and U.S. provisional application Ser. No. 61/557,352, filed on Nov. 8, 2011. The entirety of each of the above-mentioned patent applications is hereby incorporated by reference herein and made a part of this specification.

TECHNICAL FIELD

The technical field relates to an illumination device and an assembling method of the illumination device.

BACKGROUND

The Light-Emitting Diode (LED) is a semiconductor component. The material for forming the light-emitting chip using the LED mainly includes group III-V chemical compounds, such as gallium phosphide (GaP) or gallium arsenide (GaAs). Using the principle of luminosity of the PN junction, the LED is capable of converting electrical energy into optical energy. The lifespan of an LED is more than a hundred thousand hours, and the LED has fast response, small size, low power consumption, low pollution, high reliability, and is suitable for mass production.

With increasing demands for energy conservation and environmental protection, it has become a world trend for people to use LED to construct lighting devices for daily life. In common practice, the LED is installed on a carrier (e.g. a printed circuit board) to become an illumination device.

Nevertheless, the LED produces a lot of heat while producing light. Therefore, the heat generated by the LED is often unable to effectively dissipate to the exterior, thus resulting in reduction of device performance. Taking the LED bulb as an example, a heat dissipation structure is disposed on the LED bulb to avoid overheating during LED light emission. If the heat dissipation efficiency of the heat dissipation structure of the LED bulb is poor, the durability of the LED bulb will be degraded. Moreover, because they are limited by the light-emitting characteristics of the LED, the conventional LED bulb is not able to achieve the illumination range of the incandescent bulb. Achieving both illumination range and heat dissipation efficiency, in order to enhance reliability of the LED, has become an important issue.

SUMMARY

According to one exemplary embodiment, an illumination device comprises a base, a heat dissipation member, at least one flexible printed circuit board (FPC), and a plurality of light-emitting elements. The heat dissipation member has a central axis, a plurality of holding curvy surfaces and a plurality of heat dissipation channels. The holding curvy surfaces and the heat dissipation channels are symmetrically staggered and arranged about a central axis, wherein each of the holding curvy surfaces is radially extended along the central axis. The flexible printed circuit board is disposed on the holding curvy surfaces. The light-emitting elements are disposed on the flexible printed circuit board.

According to one exemplary embodiment, an assembling method of an illumination device comprises a base, and a heat dissipation member is assembled to the base. The heat dissipation member has a central axis, a plurality of holding curvy surfaces extending along the central axis, and a plurality of heat dissipation channels. The holding curvy surfaces and the heat dissipation channels are symmetrically staggered and arranged about the central axis. A plurality of light-emitting elements are disposed on at least one flexible printed circuit board. The flexible printed circuit board is assembled onto the heat dissipation member, and the light-emitting elements are located on the corresponding holding curvy surfaces. At least one optical element is assembled to the heat dissipation member for covering the light-emitting elements.

DESCRIPTION OF EMBODIMENTS

Figure 1:
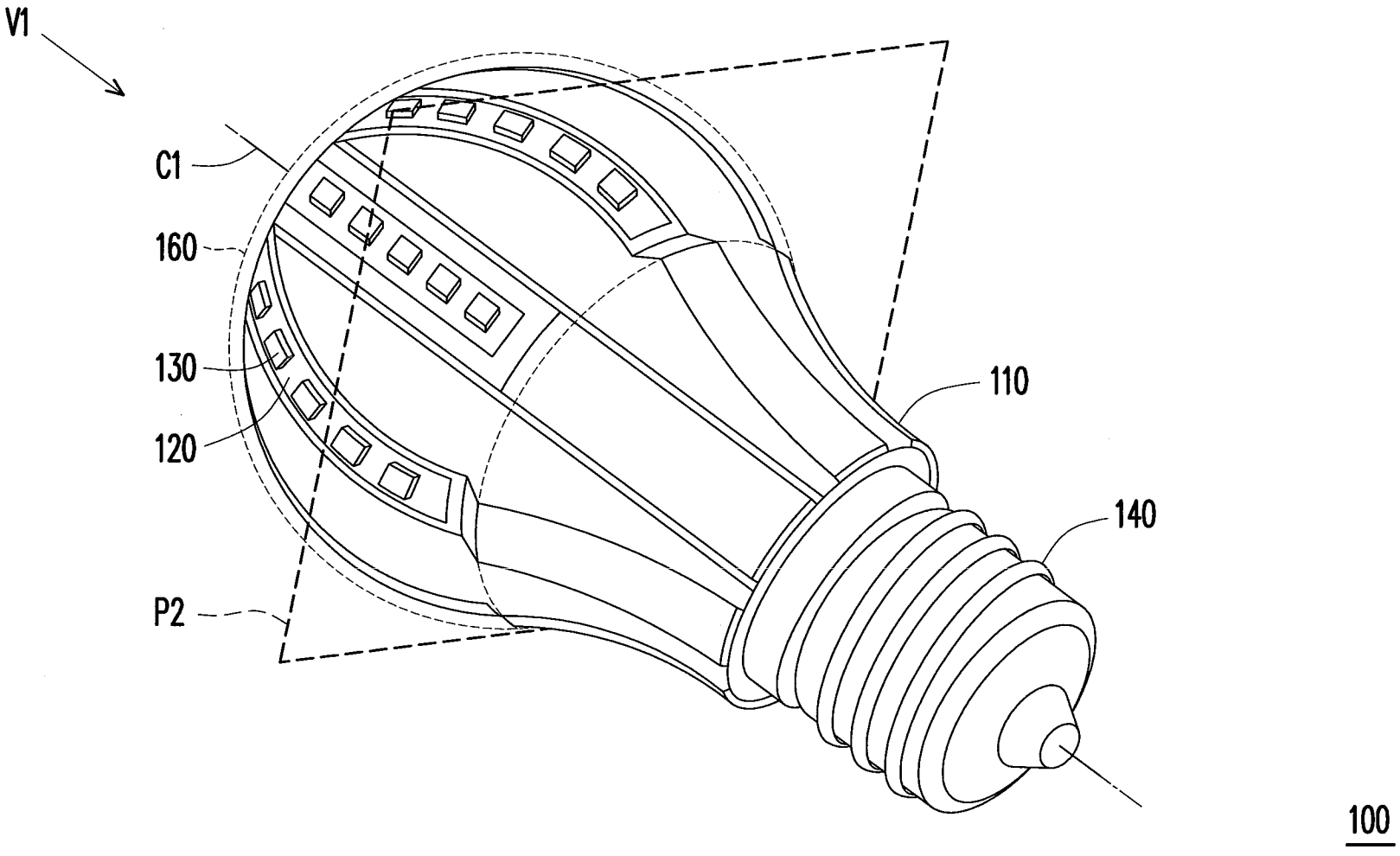
FIG. 1 is a schematic diagram illustrating an illumination device in accordance with one exemplary embodiment.
Figure 2:
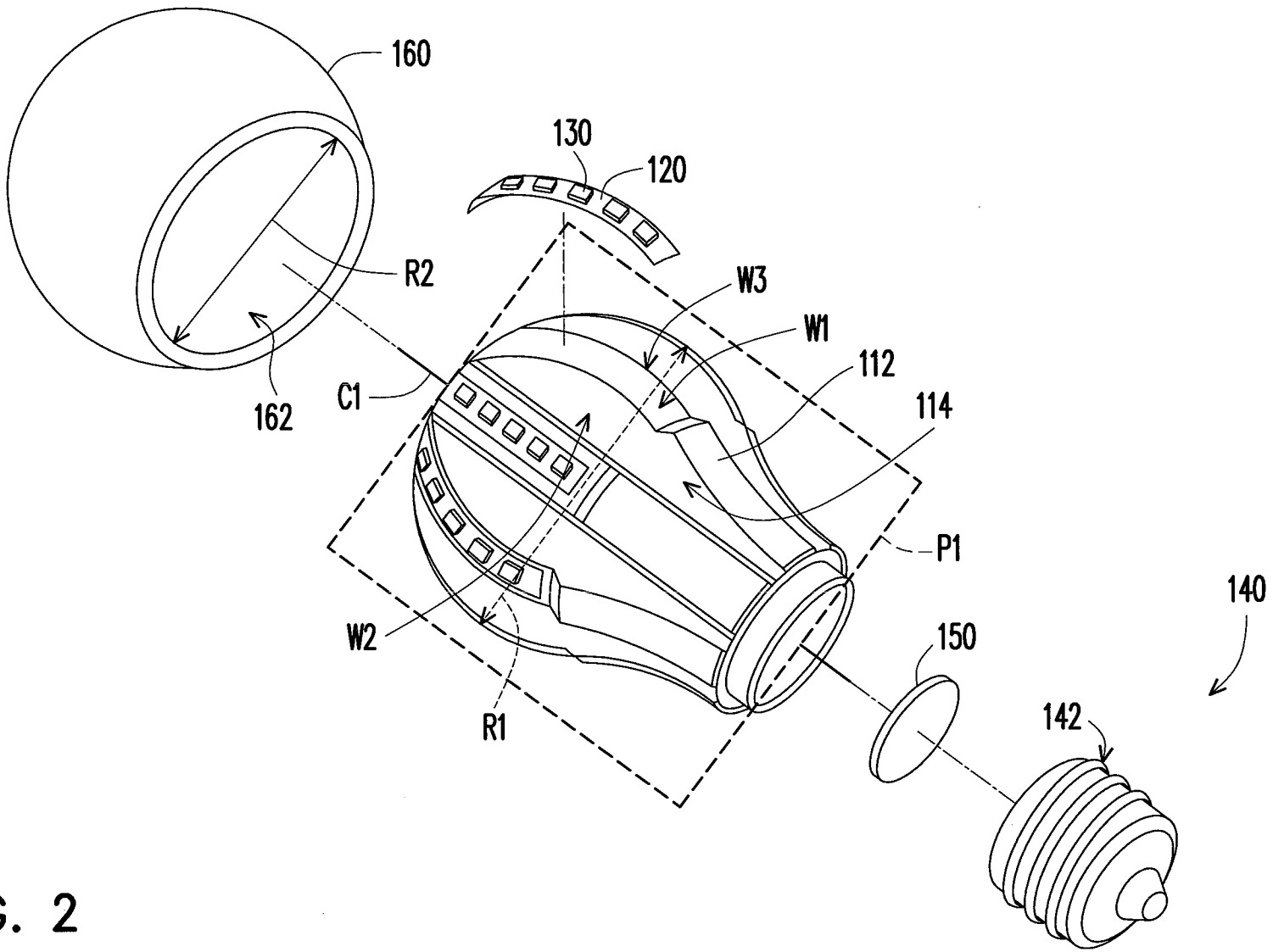
FIG. 2 is an explosion diagram of the illumination device in FIG. 1.

FIG. 1 is a schematic diagram illustrating an illumination device in accordance with one exemplary embodiment. FIG. 2 is an explosion diagram of the illumination device in FIG. 1. Referring to FIG. 1 and FIG. 2, the illumination device 100 is a bulb which comprises a heat dissipation member 110, a plurality of flexible printed circuit boards (FPSs) 120, a plurality of light-emitting elements 130, a base 140, a circuit board 150, and an optical element 160. The heat dissipation member 110 is integrally formed of thermal conductive plastic for instance or is formed of metal with good thermal conductivity, and the heat dissipation member 110 has a central axis C1, a plurality of heat dissipation petals 112 and a plurality of heat dissipation channels 114, wherein the heat dissipation petals 112 and the heat dissipation channels 114 are symmetrically staggered and arranged about the central axis C1.

Furthermore, each of the heat dissipation petals 112 has a holding curvy surface W1 and two opposite sidewalls W2, W3 adjoining the holding curvy surface W1, wherein each of the holding curvy surfaces W1 is radially extended along the central axis C1. Each of the heat dissipation channels 114 is substantially the space between the two opposite sidewalls W2, W3 of two adjacent heat dissipation petals 112. The flexible printed circuit board 120 is disposed on the holding curvy surface W1 of the heat dissipation petal 112 along the surface profile of the heat dissipation member 110, but the flexible printed circuit board 120 could also bridge over the holding curvy surfaces W1 of two adjacent heat dissipation petals 112. The light-emitting element 130, such as a Light-Emitting Diode packaged on the flexible printed circuit board 120, is disposed on the flexible printed circuit board 120 by using surface-mount technology (SMT) or COB process (Chip On Board), but the process for disposing the light-emitting element 130 on the flexible printed circuit board 120 is not limited herein.

The circuit board 150 assembled between the base 140 and the heat dissipation member 110 is electrically connected to the flexible printed circuit board 120 and the light-emitting element 130 thereon. In addition, the base 140 has a conductive portion 142 that the flexible printed circuit board 120 is electrically connected to, such that the electricity is transported to and lights up the light-emitting elements through the conductive portion 142, the circuit board 150 and the flexible printed circuit board 120. Moreover, the optical element 160, e.g. a cover, is assembled on the heat dissipation member 110 for covering the flexible printed circuit board 120 and the light-emitting element 130 thereon. The optical element 160 has at least one opening 162, wherein a largest outer diameter R1 of the heat dissipation member 110 is greater than an inner diameter R2 of the opening 162. The opening 162 of the optical element 160 is elastic, and thus is capable of socketing to the heat dissipation member 110. In the embodiment, the optical element 160 is a protective structure of the flexible printed circuit board 120 and the light-emitting element 130. Remote phosphor or a diffuser could be added in the raw materials or on the interior wall of the optical element 160 so as to transform the wavelength or enhance the scattering effect of the illumination device 100.

Based on the above, the light-emitting element 130 has the characteristic of the flexible printed circuit board 120, and may change the light-emitting range and direction with the surface profile of the heat dissipation member 110. Specifically, the flexible printed circuit board 120 and the light-emitting element 130 are adapted to form a light source with a flexible shape, so as to change the light-emitting direction and range of the light-emitting element 130, in accordance with the shape profile of the components upon which it depends. Consequently, the illumination device 100 has a wider illumination range and higher heat dissipation efficiency.

Figure 3:
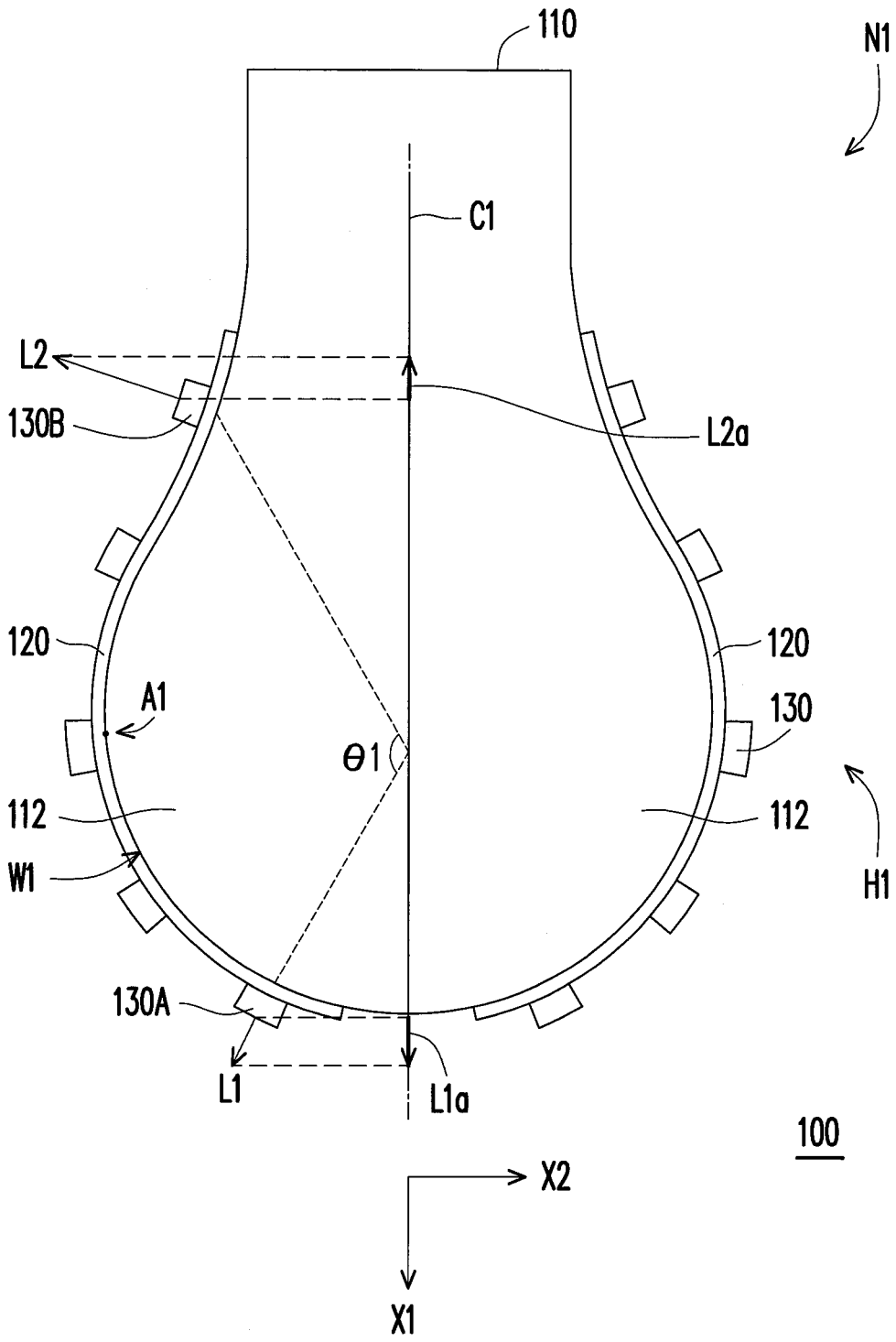
FIG. 3 is a partial cross-sectional diagram along the plane P1 of the illumination device in FIG. 2.

FIG. 3 is a partial cross-sectional diagram along the plane P1 of the illumination device in FIG. 2, and the central axis C1 is located on the plane P1. Since the heat dissipation petals 112 are symmetrically arranged about the central axis C1 only one heat dissipation petal 112 is described herein, and the rest of the heat dissipation petals 112 are all equivalent to this description.

By the way, a cylindrical coordinate system with a longitudinal axis X1 and a polar axis X2 is provided in the disclosure, wherein the central axis C1 is equal to the longitudinal axis X1 of the cylindrical coordinate system. The holding curvy surfaces W1 is radially extended along the central axis C1 described above means that the holding curvy surfaces W1 is on a cylindrical surface but with variable radii along the central axis C1.

Referring to FIG. 1~FIG. 3, an orthogonal projection of the holding curvy surface W1 of the heat dissipation petal 112 on the plane P1 is a curve with an inflection point A1. In further explanation of the illumination device 100 in FIG. 1, the partial holding surface W1 of the heat dissipation petal 112, which is covered by the optical element 160, is substantially a partial spherical surface. Specifically in FIG. 3, the curve, which is formed by an orthogonal projection of the holding curvy surface W1 on the plane P1, has an opening angle θ1 greater than 90 degrees. Consequently, the flexible printed circuit board 120 disposed on the holding curvy surface W1 is a curvy surface in identical curvature with the holding curvy surface W1.

In the embodiment, an orthogonal projection of the heat dissipation petal 112 on the central axis C1 is, for example, a line segment. Two light-emitting elements 130A, 130B are located at two opposite ends on the central axis C1. The orthogonal projection vectors L1*a*, L2*a* of the emitted light vectors L1, L2 of the two light-emitting elements 130A, 130B on the central axis C1 are opposite in directions. In light of this, the light-emitting elements 130 could be disposed on the holding curvy surface W1 between the ranges of the two light-emitting elements 130A, 130B. Specifically, the light-emitting elements 130 in FIG. 3 are adapted to be disposed on the holding curvy surface W1 across the inflation point A1 with the deposition of the flexible printed circuit board 120. Accordingly, the light-emitting elements 130 are disposed along the surface profile of the holding curvy surface W1 so as to increase the light emitting range of the illumination device 100, even if the light-emitting angle (the opening angle θ1) of the illumination device 100 is greater than 90 degrees. Specifically, the Light-Emitting Diode, as the light source of the illumination device 100 in the embodiment, overcomes the limit of the light-emitting angle, thus conforms to the illumination range of the conventional incandescent bulb.

Referring to FIG. 3, the heat dissipation member 110 is divided into a head portion H1 and a neck portion N1 according to the appearance, wherein the light-emitting elements 130 are all located on the head portion H1 of the heat dissipation member 110, and the minimum outer diameter of the head portion H1 is substantially greater than the maximum outer diameter of the neck portion N1. Specifically, the profile of the neck portion N1 is not greater than of the head portion H1. As a result, this avoids the emitted light from the light-emitting elements 130B being shielded by the neck portion N1 due to the neck portion N1 being too large and reducing the light-emitting efficiency of the illumination device 100.

Figure 4:
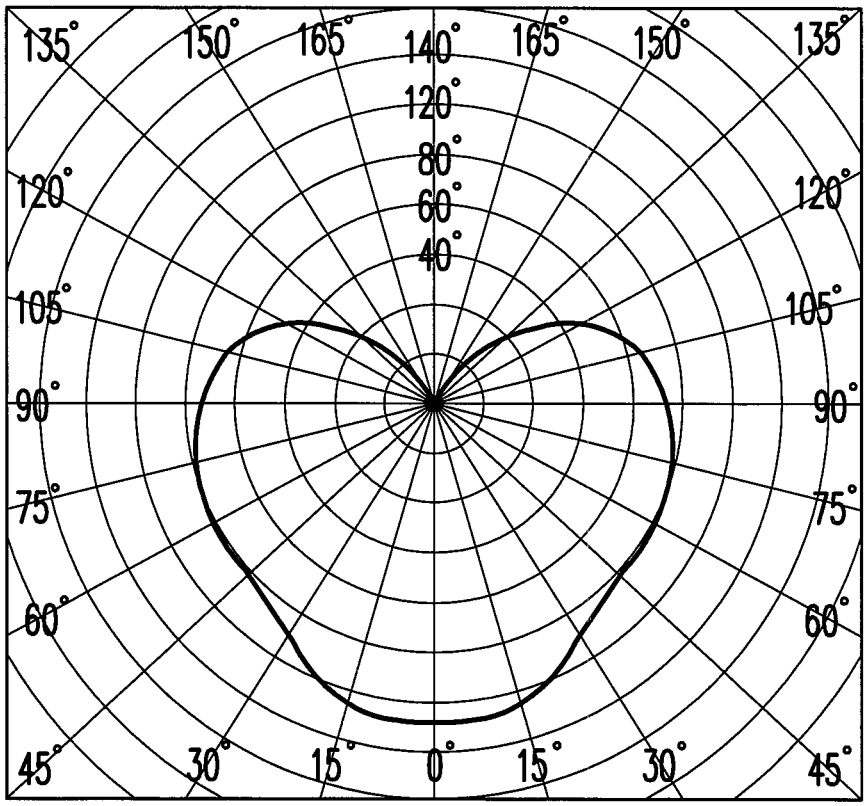
FIG. 4 is a light distribution diagram of the illumination device in FIG. 3.
Figure 5:
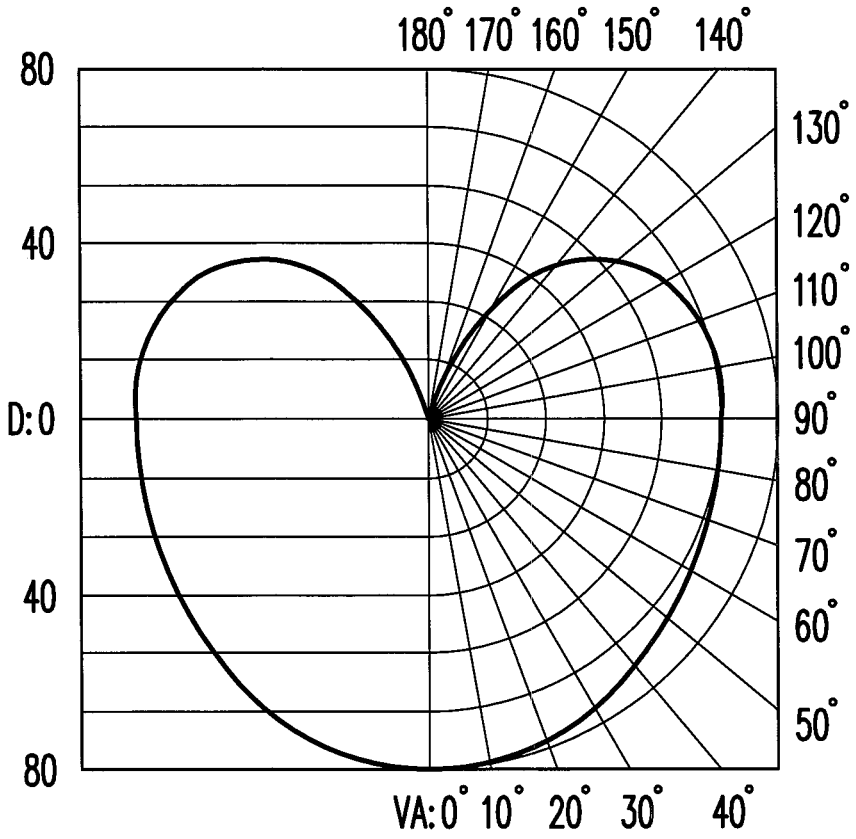
FIG. 5 is a light distribution diagram of a type A19 conventional incandescent bulb.

FIG. 4 is a light distribution diagram of the illumination device in FIG. 3. FIG. 5 is a light distribution diagram of a type A19 conventional incandescent bulb, wherein the illumination device 100 in FIG. 4 and the incandescent bulb in FIG. 5 are both disposed in the same state (such as the state shown in FIG. 3) in order to compare the light-emitting distribution. Referring to FIG. 3, FIG. 4 and FIG. 5, in the illumination device 100 of FIG. 3, the light-emitting elements 130 are equidistantly arranged from each other along the holding curvy surface W1 of the heat dissipation petal 112, and the light distribution diagram, which is generated by the light-emitting elements 130, is very similar to the brightness and the range of the type A19 incandescent bulb. Therefore, the deposition of the light-emitting elements 130 could be further adjusted, so that the illumination device 100 would be able to conform to the light-emitting requirements of the type A19 incandescent bulb.

Figure 6:
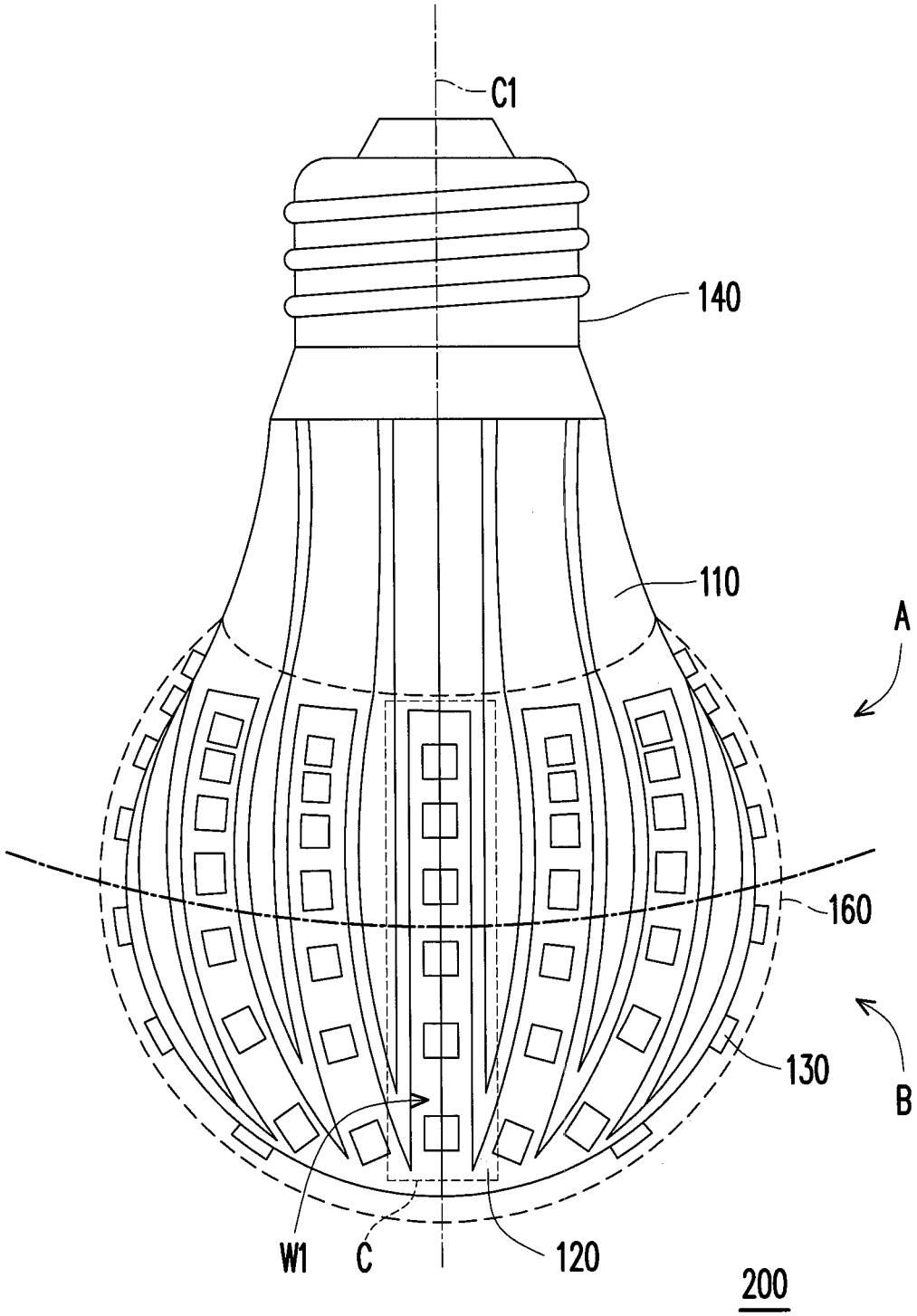
FIG. 6 is a side view diagram of an illumination device in accordance with one exemplary embodiment.

FIG. 6 is a side view diagram of an illumination device in accordance with one exemplary embodiment. Referring to FIG. 6, in the illumination device 200, the spacing of the orthogonal projections of the light-emitting elements 130 on the central axis C1 is variable along the central axis C1. In other words, the arrangement density of the light-emitting elements 130 is increasing from the optical element 160 towards the base 140, so as to enhance the brightness towards the base 140 during operation of the illumination device 200. In order to achieve the specific light distribution curve of the illumination device 200, the spacing of the orthogonal projections of the light-emitting elements 130 on the central axis C1 could be increased, decreased, or a combination thereof along the central axis C1. Other than changing the arrangement density of the light-emitting elements 130, the light intensity of the light source could also be changed, such that the light source could be replaced with a higher intensity light-emitting diode along with a denser arrangement when more brightness is required. The arrangement of the light-emitting elements 130 on the flexible printed circuit board 120 and the heat dissipation petal 112 is not limited to the exemplary embodiment, and it is possible to make appropriate adjustment according to the application requirements in order to generate the needed light distribution curve.

Similarly, the profile of heat dissipation petals 112 is also not limited to the aforesaid embodiment. The profile of the heat dissipation petals 112, with the flexible printed circuit board 120, could be changed according to the requirements of illumination in order to adjust the illumination range of the illumination device 100. In an alternative embodiment (not shown), the profile of the holding curvy surface of the heat dissipation petal could be a curvy surface with a plurality of inflection points so as to generate a specific brightness and light emitting range.

Moreover, the illumination mode of the illumination device 200 could be done via the control circuit (or microprocessor, etc, not shown). In the following, the illumination device 200 in FIG. 6 is used as an example to depict the driven mode in different regions.

The illumination device 200 in FIG. 6 is divided into disposing regions A, B in up and down manner along the central axis C1 with independent brightness/darkness and illumination intensities due to the aforesaid control circuit. For example, the light-emitting elements 130 of region A or region B may be controlled to generate a full brightness or complete darkness effect when local light sources in specific directions are needed, and the brightness of the light-emitting elements 130 could also be further controlled.

Furthermore, in an alternative embodiment, the light-emitting elements 130 could also be divided into a plurality of regions C according to their deposition on the holding curvy surfaces W1, and each of the regions C could be independent or relative to each other. In an embodiment, the light-emitting elements 130, which are in each region C, could be controlled to emit light individually. In an alternative embodiment, parts of the adjacent holding curvy surfaces W1, or holding curvy surfaces W1 with certain spacing, could be considered as the same region in order to control the light emitted.

In addition, light-emitting elements 130 with different wavelengths or different density arrangements, could be disposed on the holding curvy surfaces W1 and at the same time the light-emitting time or light-emitting frequency could be adjusted by the control circuit. As a result, the application scope of the illumination device 200 can be improved. The method for controlling the light-emitting module of the light-emitting elements is not being limited herein, and appropriate changes could be made according to the requirements.

Figure 7:
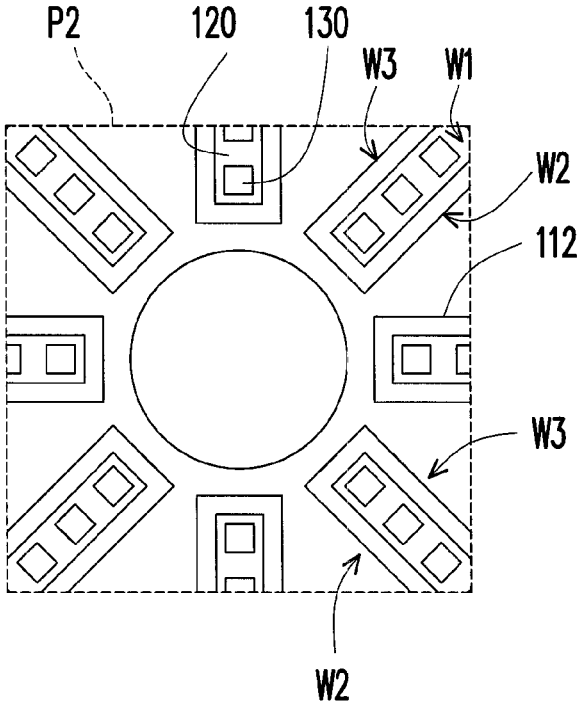
FIG. 7 is the top view diagram along the perspective angle V1 of the illumination device in FIG. 1.

Conversely, FIG. 7 is the top view diagram in the perspective angle V1 of the illumination device in FIG. 1. Referring to FIG. 1 and FIG. 7, the light-emitting elements 130 are disposed on the holding curvy surfaces W1 of the heat dissipation petals 112 with the flexible printed circuit boards 120. Thus, heat generated by light-emitting elements 130 is able to be dissipated into the heat dissipation channels 114 through the two sidewalls W2, W3. With the installation direction of the illumination device 100 shown in FIG. 3, the heat dissipation channels 114 may be vertically aligned so as to generate an air convection effect for accelerating the heat dissipation. The aforesaid flexible printed circuit boards 120 are strip-shaped, and the orthogonal projection of the flexible printed circuit boards 120 with the light-emitting elements 130 on a normal plane P2 of the central axis C1 is radial-shaped or radial-aligned, as shown in FIG. 7, and the heat dissipation channels 114 are located between the two sidewalls W1, W2. As a result, the sidewalls W2, W3 of the heat dissipation petals 112 could be the heat dissipation interface of the illumination device 100. Specifically, the areas without any flexible printed circuit boards 120 and light-emitting elements 130 disposed thereto, could be used for heat dissipation. Therefore, heat dissipation efficiency of the illumination device 100 and the operating lifespan of the light-emitting elements 130 can be improved.

Figure 8:
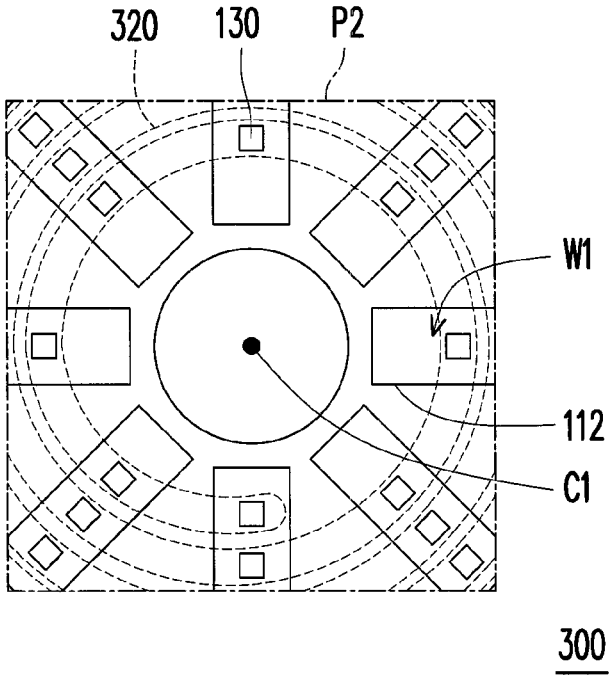
FIG. 8 is a top view diagram of an illumination device in accordance with one exemplary embodiment.

FIG. 8 is a top view diagram of an illumination device in accordance with one exemplary embodiment. Referring to FIG. 8, the orthogonal projection of the flexible printed circuit board 320 of the illumination device 300 on the normal plane P2 of the central axis C1 is helical-shaped, different from the plurality of flexible printed circuit boards 120 disposed on the holding curvy surfaces W1 of the heat dissipation petals 112 presented in the aforesaid embodiments. Specifically, the flexible printed circuit board 320 is a helical structure, which is radially extended from the adjacent central axis Cl along the heat dissipation member 110, wherein the light-emitting elements 130 are disposed on the helical flexible printed circuit board 320 and positioned on the holding curvy surfaces W1 of the heat dissipation petals 112. The light-emitting elements 130 are positioned on the intersections of the flexible printed circuit board 320 and the holding curvy surfaces W1 of the heat dissipation petals 112, so as to dissipate heat generated by the light-emitting elements 130 through the heat dissipation petals 112. In an alternative embodiment (not shown), the orthogonal projection of the flexible printed circuit board on the normal plane of the central axis could be arcuate, circular or concentric circular shaped.

Figure 9:
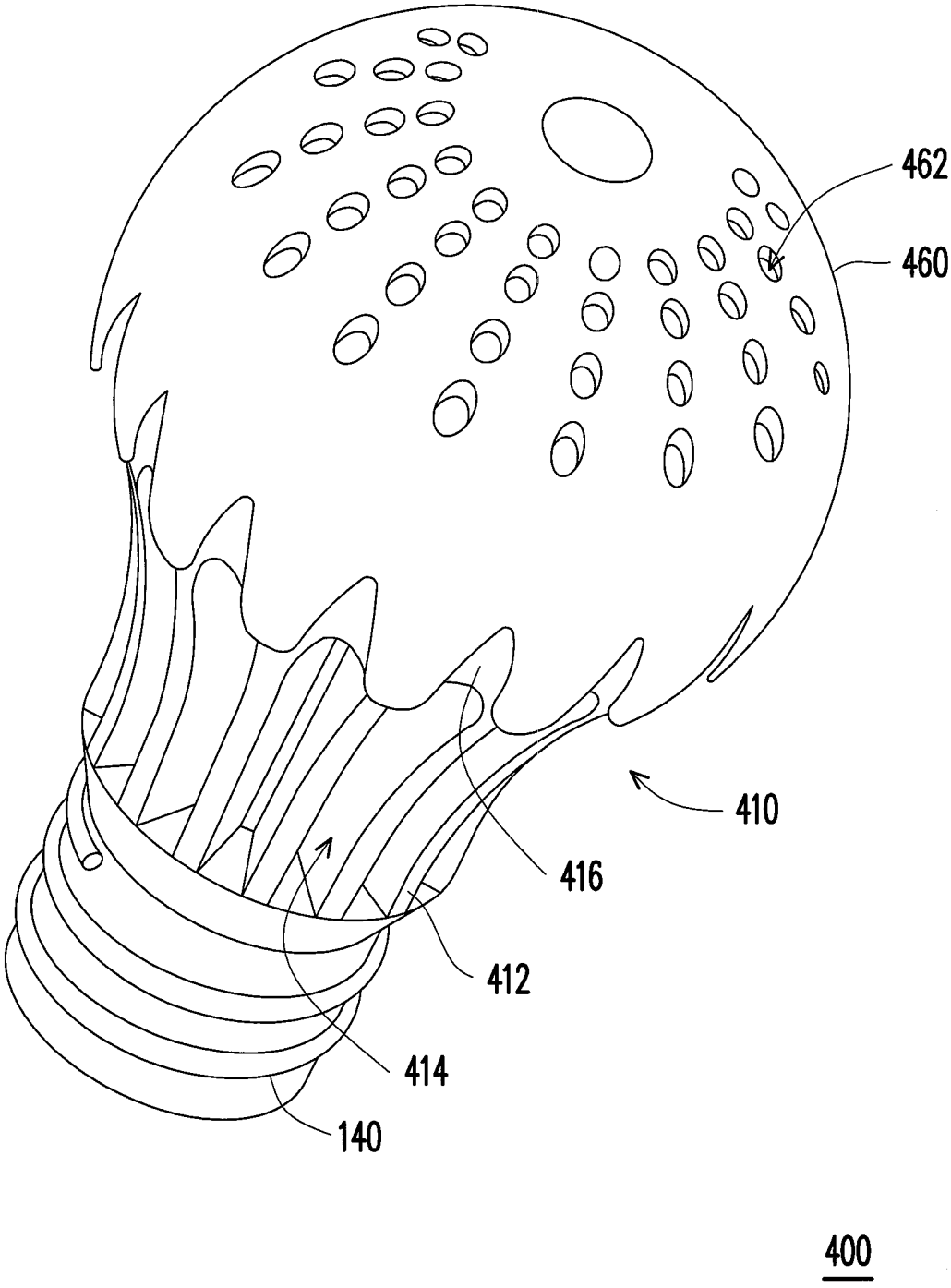
FIG. 9 is a schematic diagram illustrating an illumination device in accordance with one exemplary embodiment.
Figure 10:
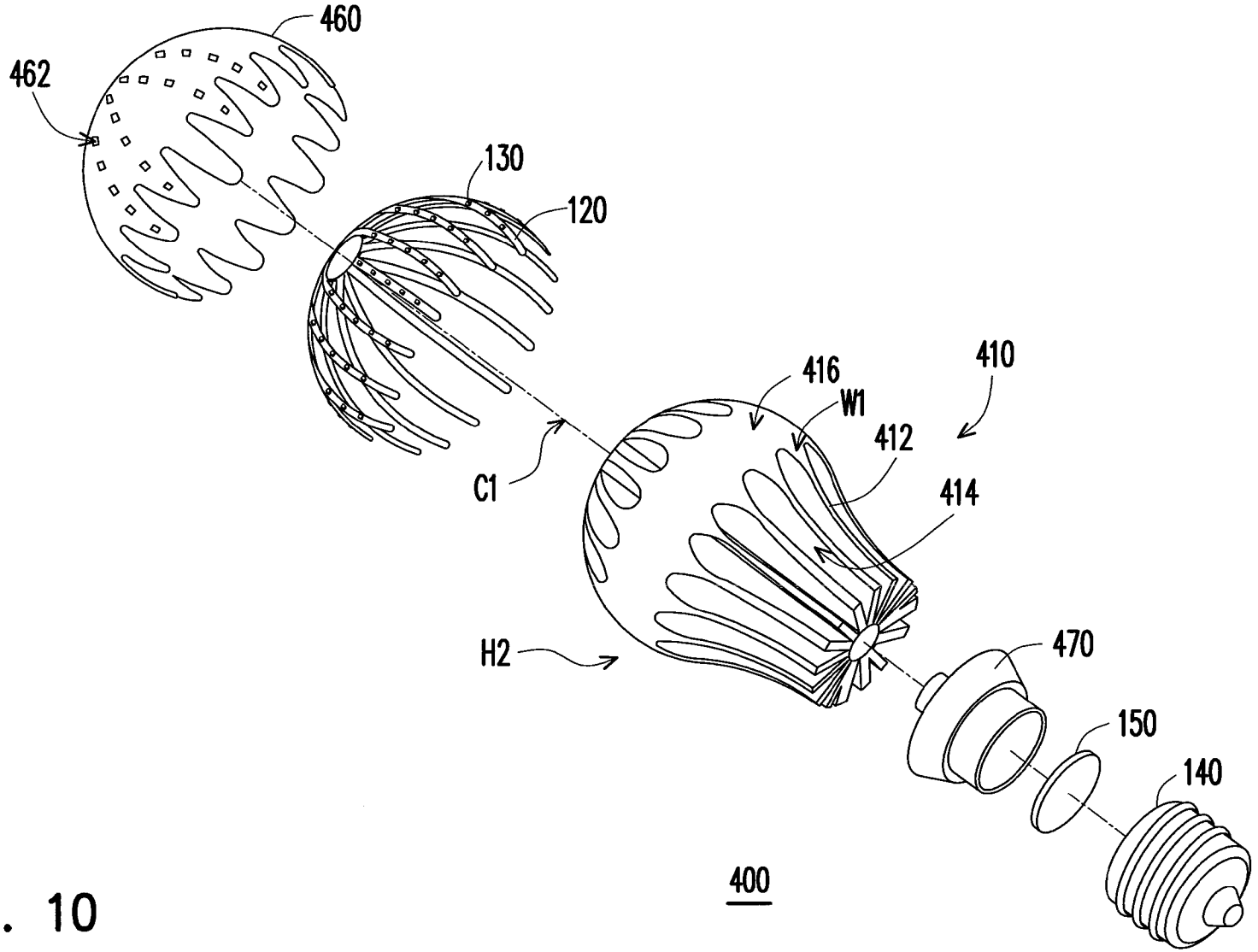
FIG. 10 is an explosion diagram of the illumination device in FIG. 9.

FIG. 9 is a schematic diagram illustrating an illumination device in accordance with one exemplary embodiment. FIG. 10 is an explosion diagram of the illumination device in FIG. 9. Referring to FIG. 8 and FIG. 10, apart from the aforesaid embodiments, the heat dissipation member 410 of the illumination device 400 further comprises a connecting part 416 connecting between two adjacent heat dissipation petals 412, covering parts of the heat dissipation channels 414, and having identical curvature with the holding curvy surfaces W1 of the heat dissipation petals 412. Hence, the connecting part 416 reinforces the structure strength of heat dissipation member 410 while not hindering the air convection within the heat dissipation channels 414, and the connecting part 416 could also be used as an extension structure of the holding curvy surfaces W1 of the heat dissipation petals 412 for holding the flexible printed circuit boards 120 and the light-emitting elements 130.

By the way, the connecting part 416 is located at a place with maximum outer diameter of the head portion H2 and extends toward opposite directions along the central axis C1.

In addition, the optical element 460 has a plurality of openings 462, and when the optical element 460 is assembled onto the heat dissipation member 410 for covering the flexible printed circuit board 120 and the light-emitting element 130 thereon, these openings 462 face toward the heat dissipation channels 414 of the heat dissipation member 410 to enhance the heat convection effect of the heat dissipation channels 414.

Moreover, since the heat dissipation member 410 is made of metallic material, the illumination device 400 further comprises an insulating member 470, which is assembled at the base 140 to insulate the heat dissipation member 410 from the base 140, so as to prevent the illumination device 400 from malfunctioning during operation.

Figure 11:
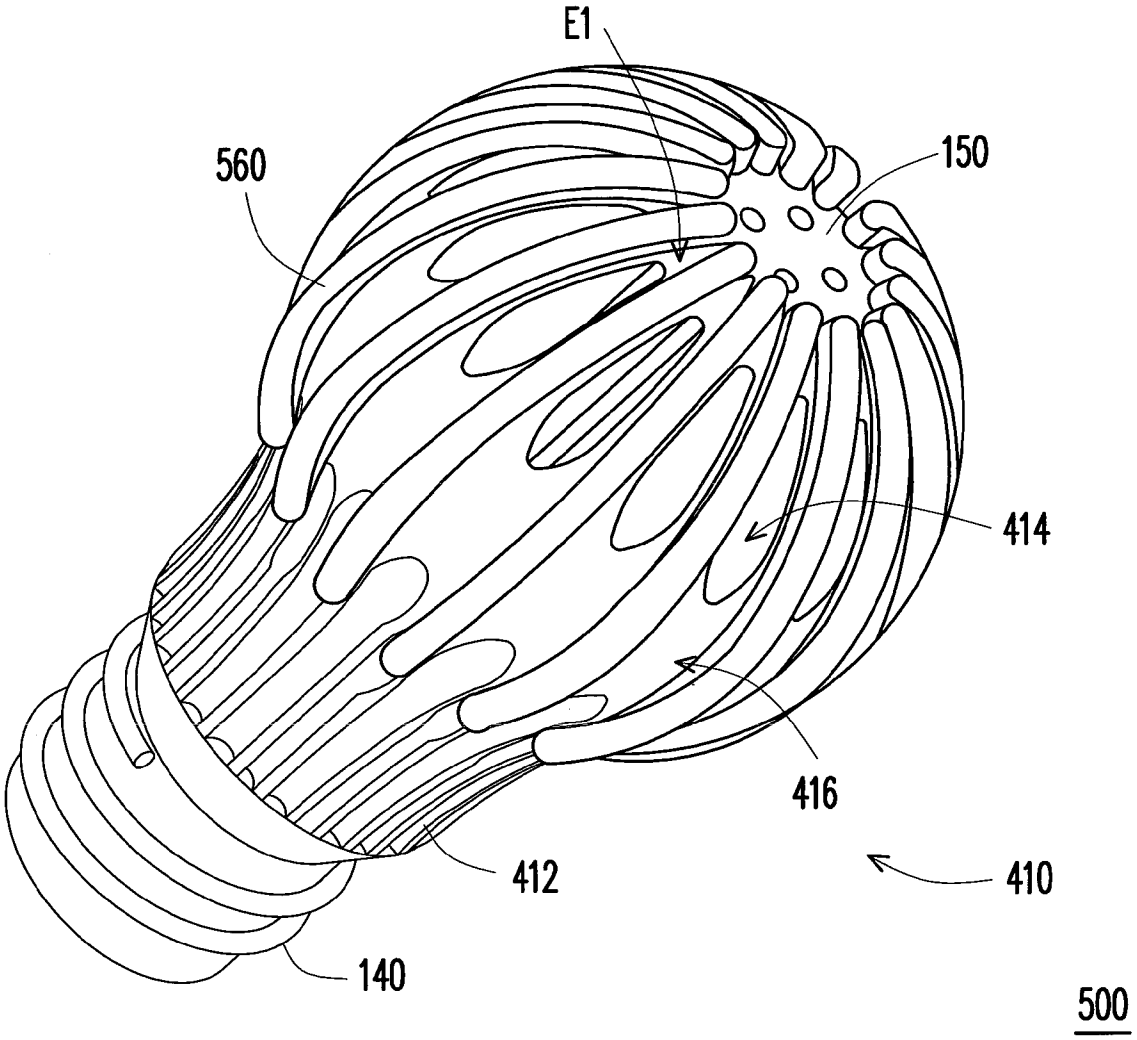
FIG. 11 is a schematic diagram illustrating an illumination device in accordance with one exemplary embodiment.
Figure 12:
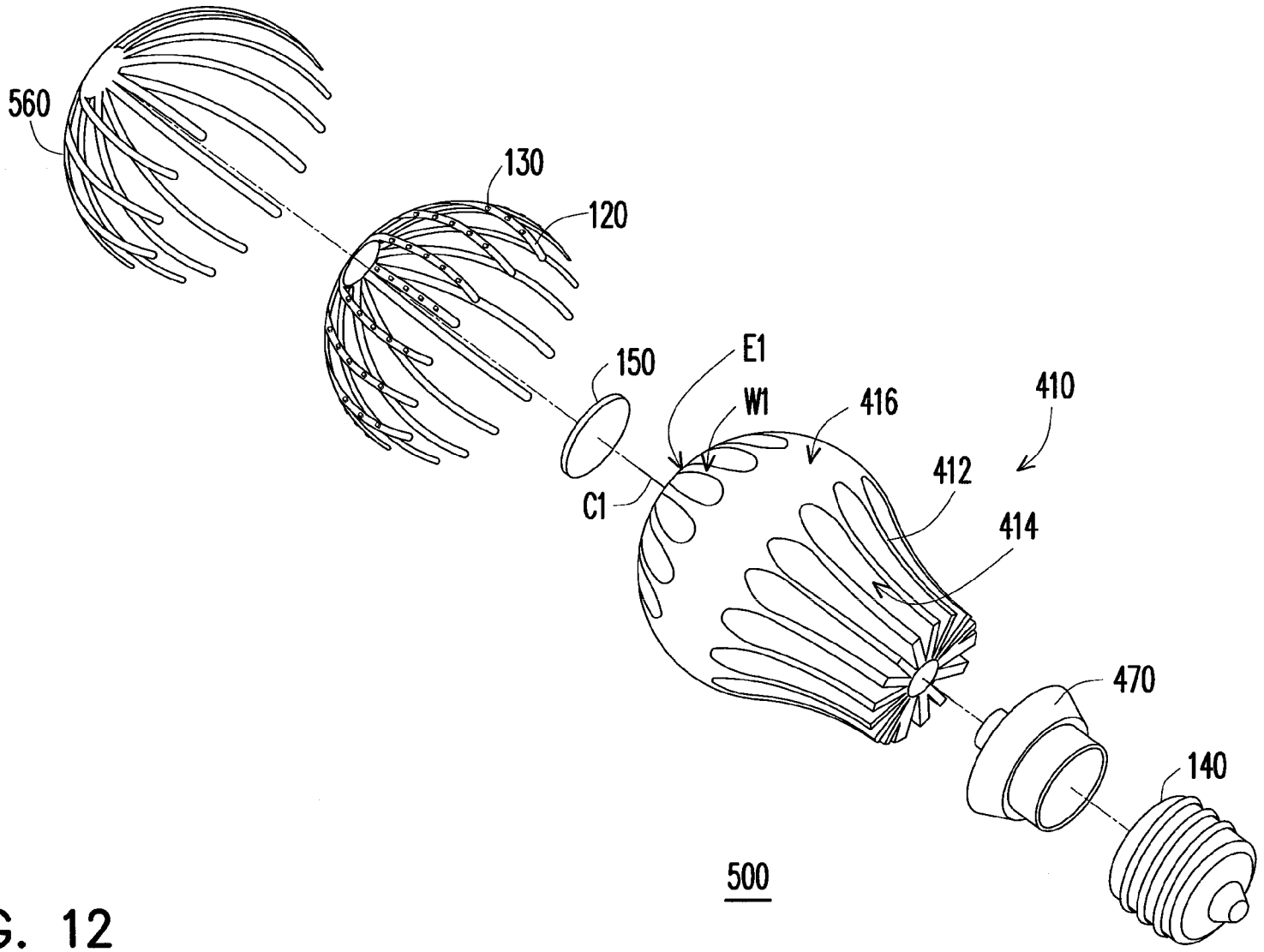
FIG. 12 is an explosion diagram of the illumination device in FIG. 11.

FIG. 11 is schematic diagram illustrating an illumination device in accordance with one exemplary embodiment. FIG. 12 is an explosion diagram of the illumination device in FIG. 11. Referring to FIG. 11 and FIG. 12, the illumination device 500 comprises a plurality of optical elements 560 disposed on the holding curvy surface W1 of the heat dissipation petal 412 respectively for covering the flexible printed circuit board 120 and the light-emitting elements 130 thereon. In addition, the circuit board 150 in circular-shaped is disposed at an end El of the heat dissipation member 410 away from the base 140, such that the flexible printed circuit boards 120 in strip-shaped is connected to the margin of the circular-shaped circuit board 150, and the central axis C1 of the heat dissipation member 410 passes through the center of the circular-shaped circuit board 150.

Herein, the shape of the disclosed optical element is not being limited, in the aforesaid embodiments of FIGS. 1, 9 and 11 for instance, the appearance of the optical element could be changed according to the requirements of illumination and heat dissipation. In an embodiment (not shown), the optical element 160 (cover) in FIG. 1 is instead of a plurality of optical lens packed on the light-emitting element 130 respectively, wherein the specification of the lens could be adjusted according to the application requirements.

Figure 13:
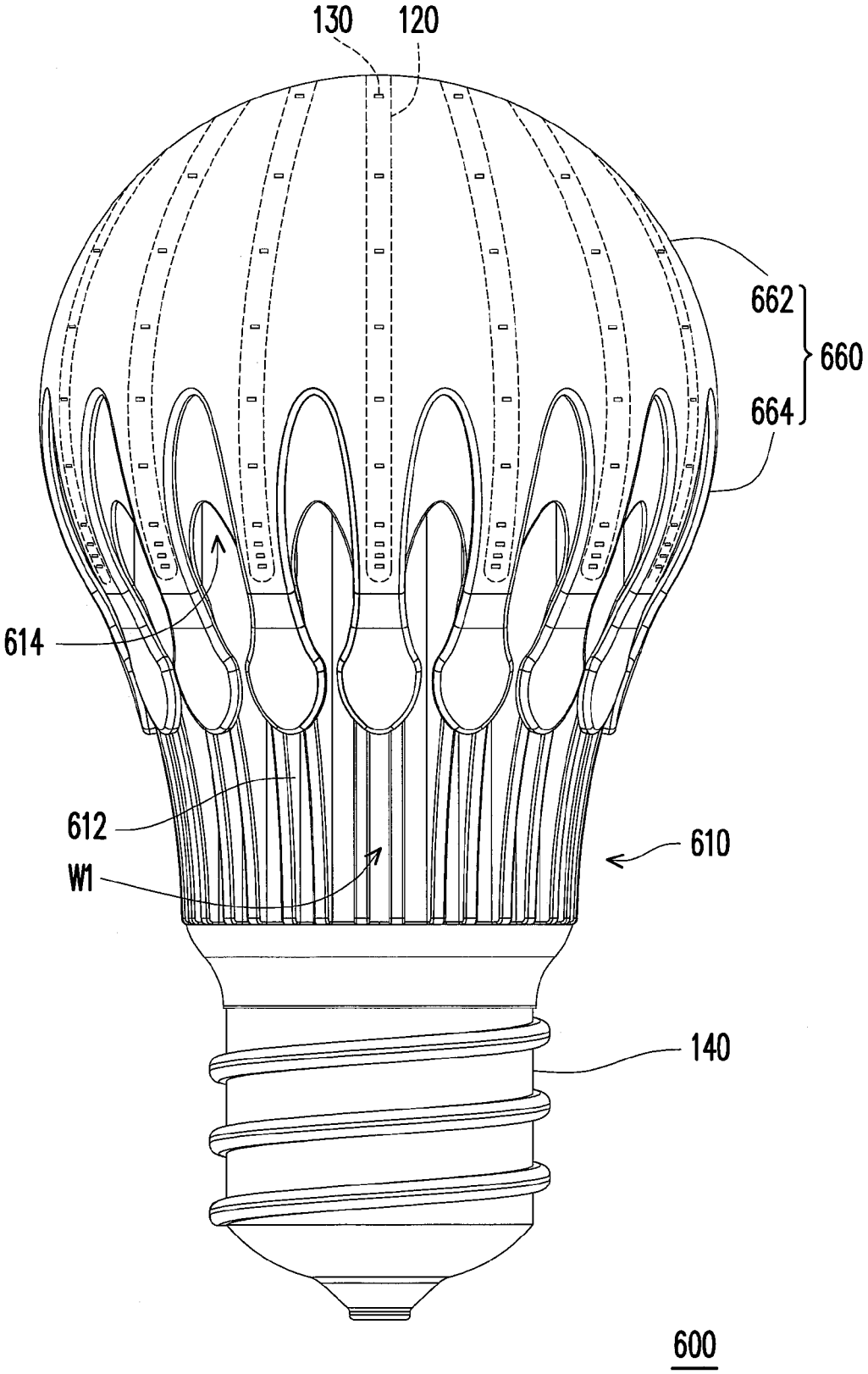
FIG. 13 is a schematic diagram illustrating an illumination device in accordance with one exemplary embodiment.
Figure 14:
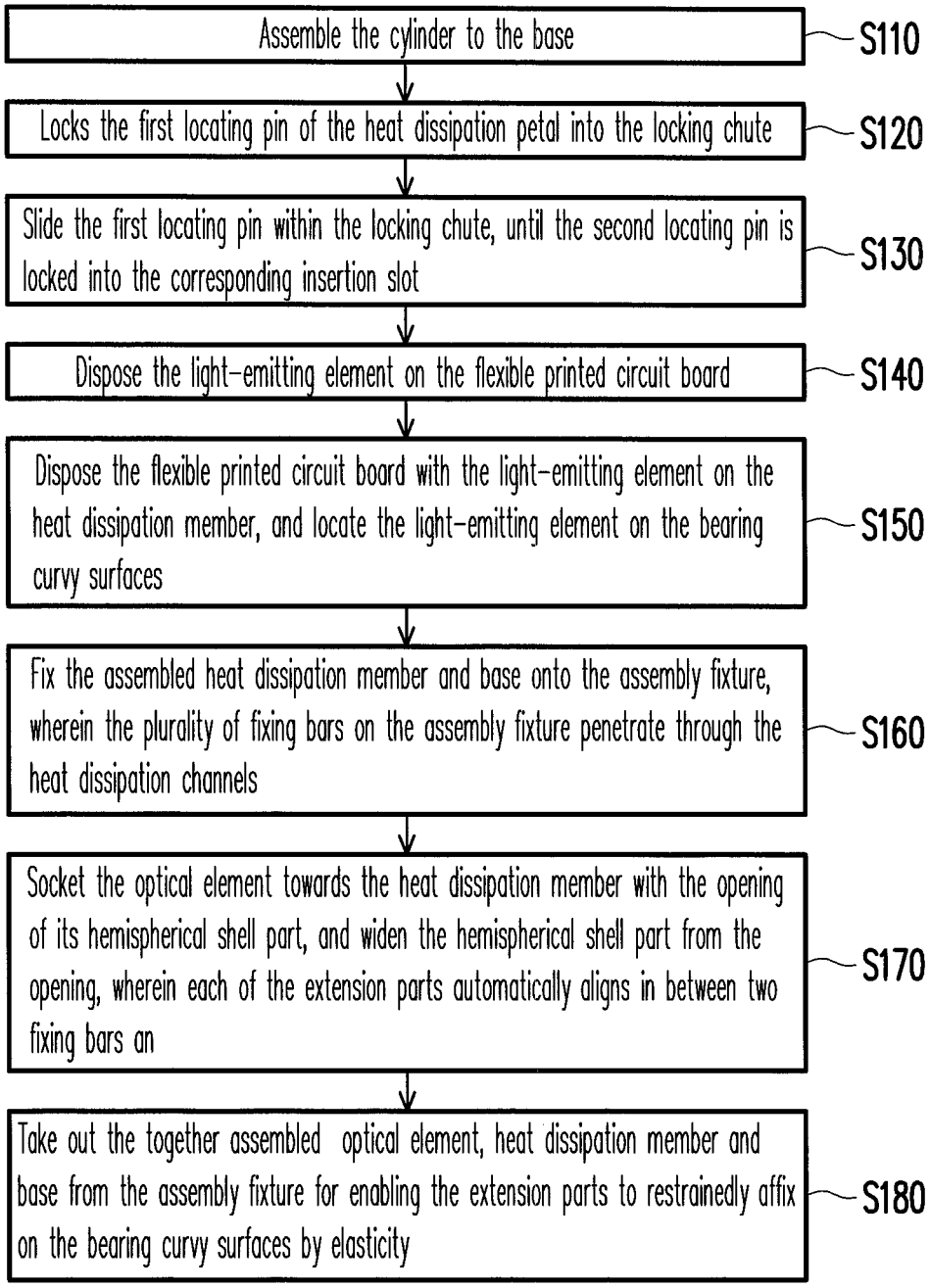
FIG. 14 is an assembly flow-chart of the illumination device in FIG. 13.

FIG. 13 is schematic diagram illustrating an illumination device in accordance with one exemplary embodiment. FIG. 14 is an assembly flow-chart of the illumination device in FIG. 13. Referring to FIG. 13 and FIG. 14, to complete the assembly of the illumination device 600 in exemplary embodiment, firstly, in step S140, dispose the light-emitting elements 130 on the flexible printed circuit board 120, and then in step S150, dispose the flexible printed circuit board 120 with the light-emitting element 130 on the heat dissipation member 610 and locate the light-emitting element 130 on the holding curvy surface W1.

Figure 15:
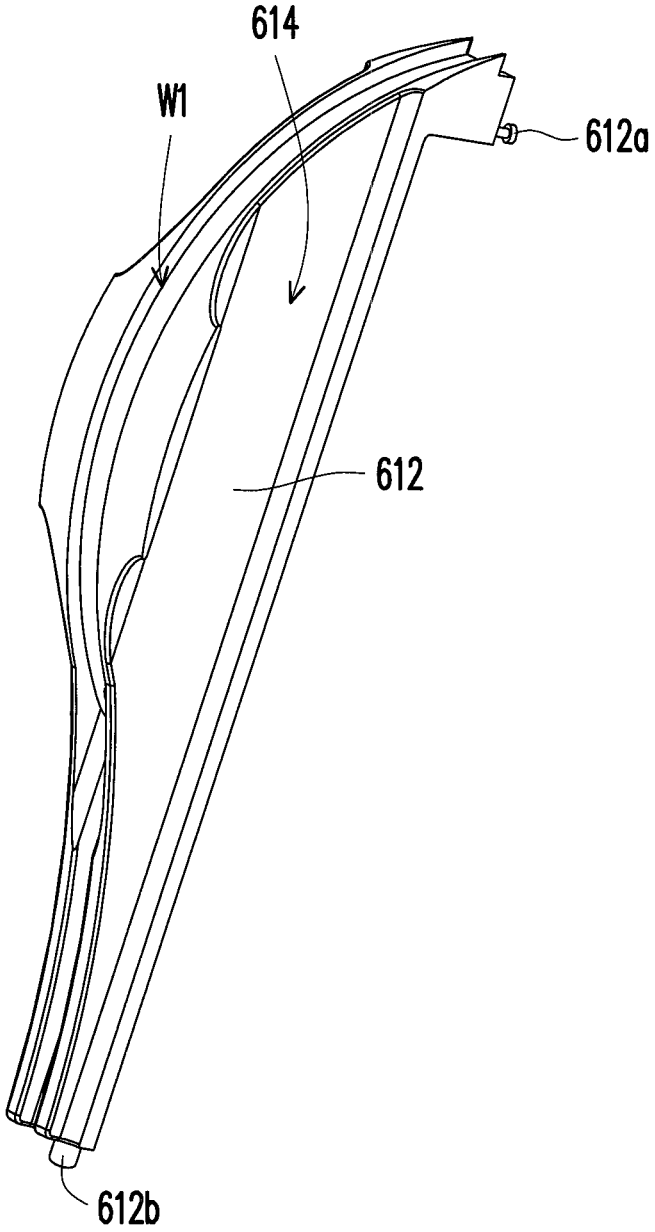
FIG. 15 is a partial schematic diagram illustrating a heat dissipation member inside of the illumination device in FIG. 13.
Figure 16:
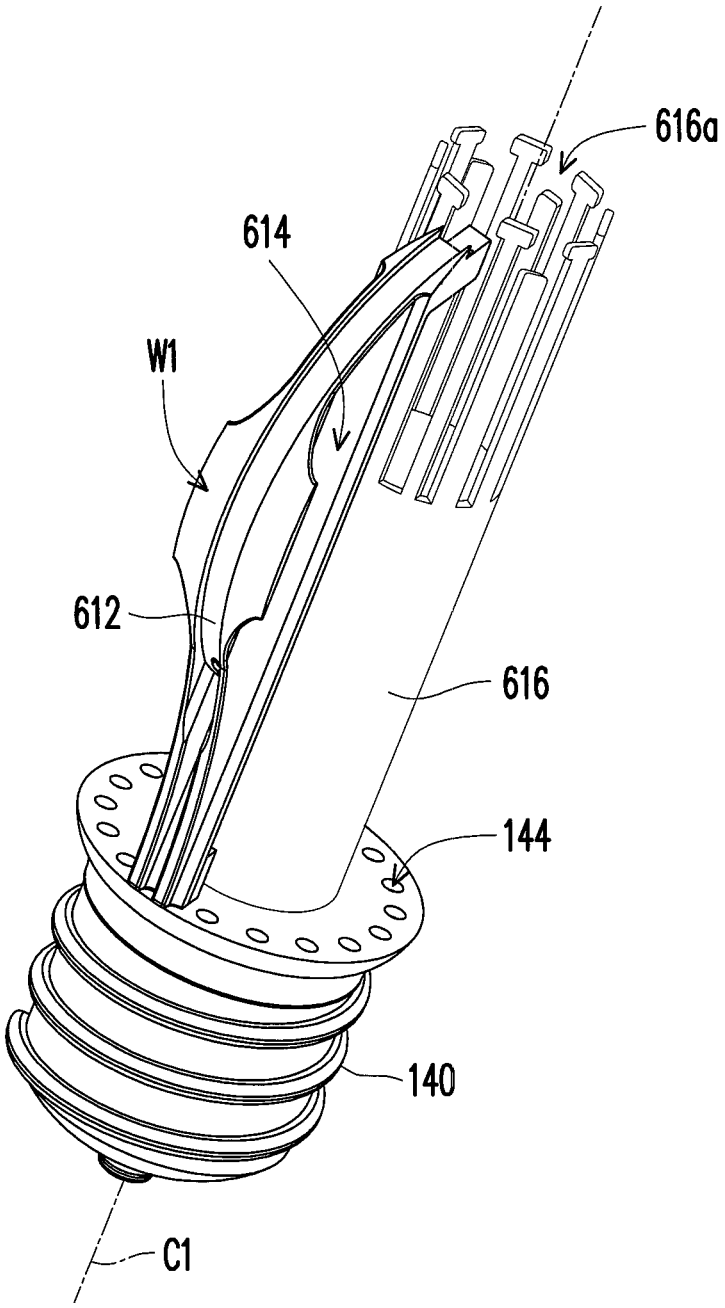
FIG. 16~FIG. 18 are schematic diagrams showing parts of the assemblies of the illumination device in FIG. 13.
Figure 17:
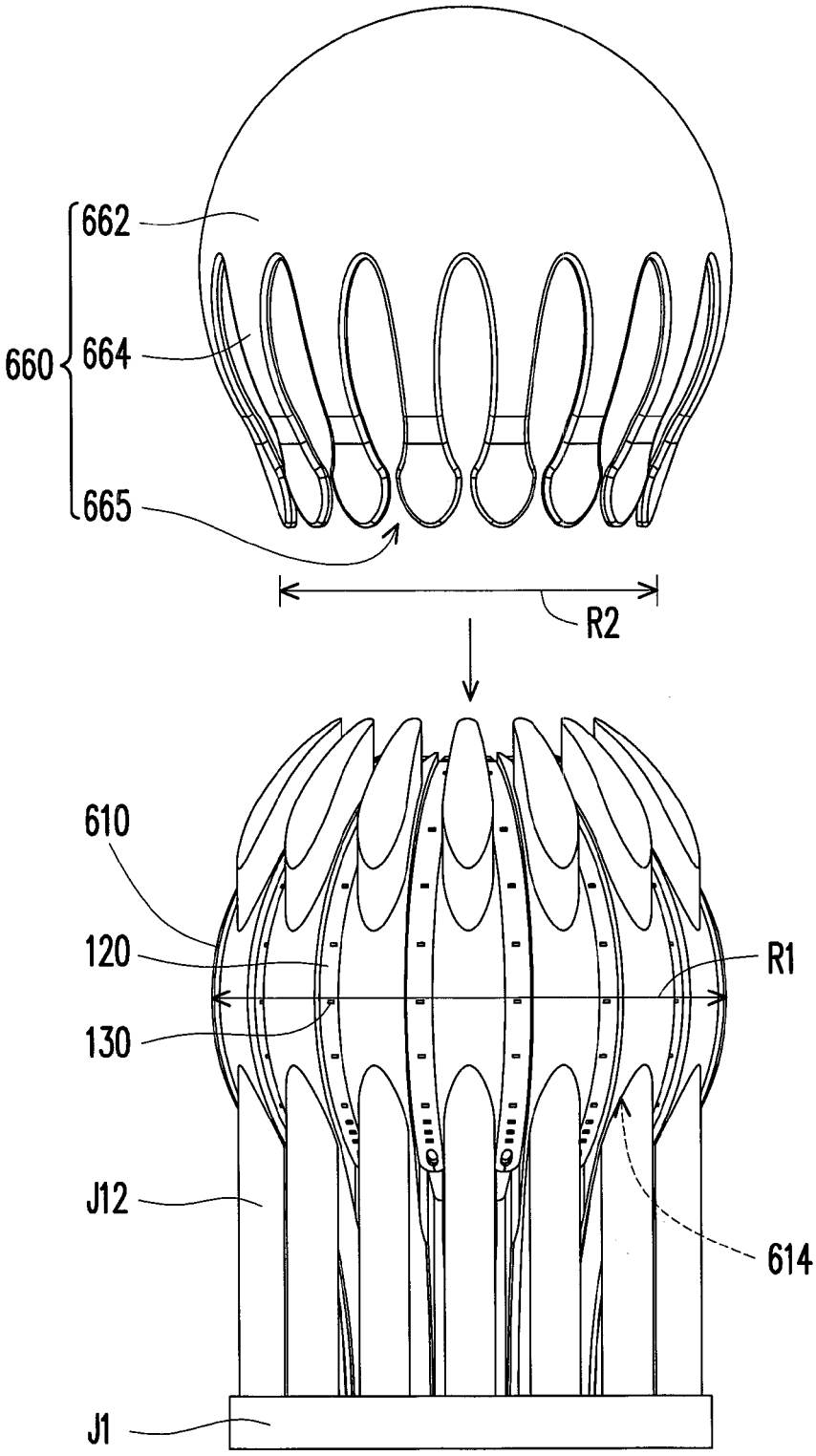
Figure 18:
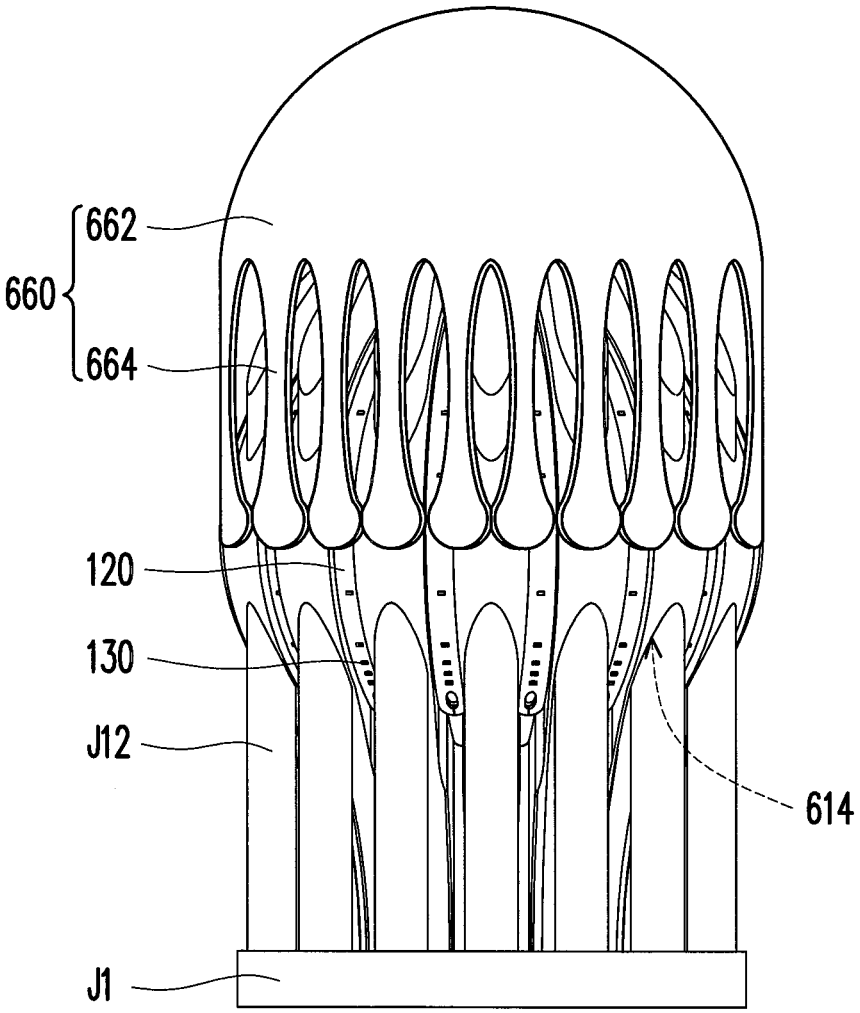

FIG. 15 is a partial schematic diagram illustrating a heat dissipation member inside of the illumination device in FIG. 13. FIG. 16~FIG. 18 are schematic diagrams showing parts of the assemblies of the illumination device in FIG. 13. Referring to FIG. 13~FIG. 18 at the same time, it is worth mentioning that the heat dissipation member 610 is configured by a plurality of heat dissipation petals 612 detachably assembled on the base 140. In detail, the heat dissipation member 610 comprises a cylinder 616, which is disposed on the base 140 and has a central axis C1, and the cylinder 616 has a plurality of locking chutes 616a, located on the cylindrical surface of the cylinder 616, extending along and about the central axis C1. Furthermore, each of the heat dissipation petals 612 has a first positioning pin 612*a* and a second positioning pin 612*b* extending away from the holding curvy surfaces W1, and the base 140 has a plurality of inserting slots 144 arranged and surrounded about the central axis C1. The second positioning pin 612*b* is locked in the corresponding inserting slot 144, such that each of the heat dissipation petals 612 is fixed on the base 140. Therefore, in step S110, the cylinder 616 is first assembled to the base 140. Next in step S120, the first positioning pin 612*a* of the heat dissipation petal 612 is locked into the locking chute 616*a*, and in step S130, the first positioning pin 612*a* is slid within the locking chute 616*a*, until the second positioning pin 612 of the heat dissipation petal 612 is locked into the corresponding inserting slot 144. Thus the heat dissipation channels 614 between the two adjacent heat dissipation petals 61 assembled on the cylinder 616 are formed.

Then, in step S160, the assembled heat dissipation member 610 and base 140 are fixed onto an assembling fixture J1, wherein a plurality of fixing bars J12 of the assembling fixture J1 penetrate through the heat dissipation channels 614 respectively. Furthermore, referring to FIG. 13 and FIG. 17, the optical element 660 comprises a hemispherical shell portion 662 and a plurality of extension portions 664 that are located at the openings of the hemispherical shell portion 662. The extension portions 664, which are extended from the hemispherical shell portion 662, form into a fence structure, and the fence structure forms another opening 664 opposite to the hemispherical shell portion 662. The maximum outer diameter R1 of the heat dissipation member 610 is greater than the inner diameter R2 of the opening 665. Herein, the optical element 660 is made of elastic materials, and the optical element 660 is in a spherical-shape without force applied. Accordingly, in step S170, the optical element 660 is socketed towards the heat dissipation member 610 with the opening 665 formed by the fence structure, wherein each of the extension portions 664 are automatically aligned between two adjacent fixing bars J12 with the elastic restoring force of the optical element and moved towards the bottom of the assembling fixture J1, and concurrently, the opening 665 is widened due to exertion force from the fixing bars J12 toward the optical element 660. Noteworthily, when the heat dissipation member 610 and the base 140 are both fixed at the assembling fixture J1, the fixing bars J12 penetrate through the heat dissipation channels 614 and poke out of the heat dissipation channels 614. Accordingly, the fixing bars J12 push up the extension portions 664 during the assembly process of the optical element 660 and then enable the extension portions 664 and the light-emitting elements 130, which are positioned on the holding curvy surfaces W1, to keep a distance to avoid contact of the extension portions 664 with the light-emitting elements 130 by rubbing against each other.

Subsequently, in step S180, the assembled optical element 660, heat dissipation member 610 and base 140 are taken out from the assembling fixture J1, and the extension portions 664 bind and affix on the holding curvy surfaces W1 with elasticity. Consequently, with the aforesaid relative structures, the process of assembling the illumination device is completed in a much simplified method.

Based on the above, the flexible printed circuit board and the light-emitting elements thereon are disposed with the surface profile of the heat dissipation member according to the flexibility of the flexible printed circuit board. Concurrently, with different disposition arrangements of the light-emitting element on the flexible printed circuit board, the illumination device is able to conform to the light distribution of the conventional incandescent bulb in order to enhance the effect of the illumination range of the illumination device.

Furthermore, the heat dissipation member is constituted of a plurality of axisymmetric heat dissipation petals with heat dissipation channels formed therebetween, and the light-emitting element is disposed on the heat dissipation petal, and thus the heat generated by the light-emitting element is able to be dissipated more effectively with the disposition arrangement of the heat dissipation petals and the heat dissipation channels. In the disclosed illumination device, the heat dissipation member areas, which are not disposed on the light-emitting elements, may also be used as a heat dissipation interface, so as to enhance heat dissipation efficiency of the illumination device.

While the invention has been described and illustrated with reference to specific embodiments thereof, these descriptions and illustrations do not limit the invention. It should be understood by those skilled in the art that various changes may be made and equivalents may be substituted without departing from the true spirit and scope of the invention as defined by the appended claims. The illustrations may not necessarily be drawn to scale. There may be distinctions between the artistic renditions in the present disclosure and the actual apparatus due to manufacturing processes and tolerances. There may be other embodiments of the present invention which are not specifically illustrated. The specification and the drawings are to be regarded as illustrative rather than restrictive. Modifications may be made to adapt a particular situation, material, composition of matter, method, or process to the objective, spirit and scope of the invention. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the invention. Accordingly, unless specifically indicated herein, the order and grouping of the operations are not limitations of the invention.

What is claimed is:

1. An illumination device comprising:

a base;

a heat dissipation member disposed on the base, wherein the heat dissipation member has a central axis, a plurality of heat dissipation petals symmetrically arranged about the central axis, a plurality of holding curvy surfaces configured on the heat dissipation petals respectively, and a plurality of heat dissipation channels extending along the central axis, and the holding curvy surfaces and the heat dissipation channels are staggered and arranged about the central axis, wherein the heat dissipation channels are located between the any two adjacent heat dissipation petals respectively, and each of the holding curvy surfaces radially extends along the central axis;

at least one flexible printed circuit board disposed on the holding curvy surfaces; and a plurality of light-emitting elements disposed on the flexible printed circuit board.

2. The illumination device as claimed in claim 1, wherein an orthogonal projection of each of the holding curvy surfaces on a plane is a curve with at least one inflection point, and the central axis is located on the plane.

3. The illumination device as claimed in claim 1, wherein the flexible printed circuit, board bridges over the holding curvy surfaces of at least two adjacent heat dissipation petals.

4. The illumination device as claimed in claim 3, wherein the flexible printed circuit board on a normal plane of the central axis is helical, arcuate or circular shaped.

5. The illumination device as claimed in claim 1, wherein the at least one flexible printed circuit board comprises a plurality of flexible printed circuit boards disposed along corresponding the holding curvy surfaces respectively.

6. The illumination device as claimed in claim 5, wherein an orthogonal projection of the flexible printed circuit boards on a normal plane of the central axis is radial-shaped.

7. The illumination device as claimed in claim 1, wherein the heat dissipation member further comprising:

a cylinder, assembled on the base and having the central axis, wherein each of the heat dissipation petals is detachably assembled on a cylindrical surface of the cylinder and the base.

8. The illumination device as claimed in claim 7, wherein each of the heat dissipation petals has a first positioning pin, the cylinder has a plurality of locking chutes located on the cylindrical surface and extending along the central axis, and the first positioning pin is locked within corresponding the locking chute, such that the heat dissipation petal is fixed on the cylindrical surface of the cylinder.

9. The illumination device as claimed in claim 8, wherein each of the heat dissipation petals further comprises a second positioning pin, the base further comprises a plurality of inserting slots arranging about the central axis, and the second positioning pin is locked in corresponding the inserting slot, such that each of the heat dissipation petals is fixed on the base.

10. The illumination device as claimed in claim 1, wherein the heat dissipation member further comprises at least one connecting part connecting between two holding curvy surfaces of the two adjacent heat dissipation petals and covering parts of the heat dissipation channels between the two adjacent heat dissipation petals.

11. The illumination device as claimed in claim 10, wherein the connecting part and the holding curvy surfaces are identical in curvature.

12. The illumination device as claimed in claim 1 further comprising:

an optical element disposed on the heat dissipation member for covering the holding curvy surfaces and the light-emitting elements thereon, wherein a surface profile of the optical element and the holding curvy surfaces are identical in curvature.

13. The illumination device as claimed in claim 12, wherein the optical element has at least one opening, and a largest outer diameter of the heat dissipation member is greater than an inner diameter of the opening.

14. The illumination device as claimed in claim 12, wherein the optical element has a plurality of openings connecting to the heat dissipation channels.

15. The illumination device as claimed in claim 12, wherein the optical element has a hemispherical shell portion and a plurality of extension portions, the extension portions extend from the hemispherical shell portions individually, and the optical element is elastic and spherical-shaped without force applied thereon.

16. The illumination device as claimed in claim 15, wherein the heat dissipation channels are adapted to be penetrated by a plurality of fixing bars of an assembling fixture, and when the optical element is assembled on the heat dissipation petals, each of the extension portions is automatically aligned between two adjacent fixing bars with an elastic restoring force of the optical element.

17. The illumination device as claimed in claim 1 further comprising:

a plurality of optical elements, wherein each of the optical elements is correspondingly disposed on a holding curvy surface for covering the light-emitting elements thereon.

18. The illumination device as claimed in claim 1 further comprising:

a plurality of optical elements, and each of the optical elements covering a light-emitting element correspondingly.

19. The illumination device as claimed in claim 1, further comprising:

a circuit board disposed at a side of the heat dissipation member adjacent to the base and electrically connecting the flexible printed circuit boards.

20. The illumination device as claimed in claim 1 further comprising:

a circuit board disposed at a side of the heat dissipation member away from the base, wherein an end from each of the flexible printed circuit boards is connected to the circuit board.

21. The illumination device as claimed in claim 1, wherein the light-emitting elements on a same holding curvy surface are equidistantly disposed along the central axis.

22. The illumination device as claimed in claim 1, wherein the light-emitting elements on a same holding curvy surface are not equidistantly disposed along the central axis.

23. An assembling method of an illumination device comprising:

providing a base;

assembling a heat dissipation member on the base, wherein the heat dissipation member has a central axis, a plurality of heat dissipation petals symmetrically arranged about the central axis, a plurality of holding curvy surfaces configured on the heat dissipation petals respectively, and a plurality of heat dissipation channels extending along the central axis, and the holding curvy surfaces and the heat dissipation channels are symmetrically staggered and arranged about the central axis, wherein the heat dissipation channels are located between the any two adjacent heat dissipation petals respectively;

disposing a plurality of light-emitting elements on at least one flexible printed circuit board;

assembling the flexible printed circuit board onto the heat dissipation member, such that the light-emitting elements are positioned on corresponding the holding curvy surfaces; and assembling at least one optical element on the heat dissipation member for covering the light-emitting elements.

24. The assembling method of the illumination device claimed in claim 23, wherein the optical element has a hemispherical shell portion and a plurality of extension portions located at the opening of the hemispherical shell portion and extending from the hemispherical shell portion, the optical element is elastic and spherical-shaped without force applied, and the assembling method of the illumination device further comprises:

fixing assembled heat dissipation member and base on an assembling fixture, wherein a plurality of fixing bars of assembling fixture penetrate the heat dissipation channels; and socketing the optical element towards the heat dissipation member with the opening of the hemispherical shell portion, and widening the opening of the hemispherical shell portion therefrom, wherein each of the extension portions is automatically aligned between two adjacent fixing bars with the elastic restoring force of the optical element; and taking out assembled optical element, heat dissipation member and base from the assembling fixture, such that the extension portions are bound and affixed on the holding curvy surfaces with the elastic restoring force of the optical element.

25. The assembling method of the illumination device claimed in claim 24, wherein when both the heat dissipation member and the base are fixed at the assembling fixture, the fixing bars penetrate through the heat dissipation channels correspondingly and poke out of the heat dissipation channels, and the fixing bars push up the extension portions during process of assembling the optical element toward the assembling fixture, and the extension portions keep a distance from the light-emitting elements located on the holding curvy surfaces for avoiding contact of the extension portions and the light-emitting elements.

26. The assembling method of the illumination device claimed in claim 23, wherein the heat dissipation member comprises a cylinder, the cylinder has the central axis, a plurality of locking chutes and a plurality of inserting slots arranged and surrounded about the central axis, each of the heat dissipation petals has the holding curvy surface, a first positioning pin and a second positioning pin extending away from the holding curvy surface, and assembly method of the illumination device further comprises:

disposing the cylinder on the base;

locking the first positioning pin of the heat dissipation petal into corresponding the locking chute; and sliding the first positioning pin within the locking chute until the second positioning pin of the heat dissipation petal is inserted and locked into corresponding the inserting slot, and the heat dissipation channel between two heat dissipation petals is formed after two heat dissipation petals are assembled onto the cylinder.

* * * * *